United States Patent [19]

McNeel

[11] 4,303,292

[45] Dec. 1, 1981

[54] MULTIPLE PIN CONNECTOR FOR MULTIPLE CONDUCTOR CABLE

[75] Inventor: William O. McNeel, Houston, Tex.

[73] Assignee: GEO Space Corporation, Houston, Tex.

[21] Appl. No.: 91,072

[22] Filed: Nov. 5, 1979

[51] Int. Cl.[3] ..... H01R 13/629

[52] U.S. Cl. ..... 339/45 M; 339/49 R; 339/75 M

[58] Field of Search ..... 339/47 R, 48, 49 R, 339/49 B, 45 R, 45 M, 75 R, 75 M

[56] References Cited

U.S. PATENT DOCUMENTS 2,265,341 12/1941 Borchert ..... 339/49 R 3,745,511 7/1973 Fussell ..... 339/49 R

*Primary Examiner*—Neil Abrams

*Attorney, Agent, or Firm*—Daniel J. Meaney, Jr.

[57] ABSTRACT

A multiple pin connector for a multiple conductor cable formed of a housing having a face plate, a hollowed-out central area and a passageway to permit a multiple conductor cable to extend from the housing exterior into the hollowed-out central area wherein the housing includes a raised "U-shaped" collar having "U-shaped" collar ends terminating in a differential locking boss having a keyway which extends toward the other end of the face plate and with a clamping lip located on the exterior of the "U-shaped" base of the raised collar, a pair of aligned inserts located in the face plate having a plurality of elongated male connectors in a first semi-circle section and a plurality of elongated female connector sockets in a second semi-circle section with the male pins and female connector sockets extending substantially perpendicular from the face plate and arranged in the inserts in a parallel spaced relationship and in identical pattern to form a hermaphrodite connector, and a stirrup interlock having bifurcated locking arms each of which terminates in a differential locking member which defines a key and a cam and the other end of the stirrup interlock terminating with a releasable clamping member with the stirrup interlock rotatable around pivotal mountings on the housing into a locking position or release positon is shown.

14 Claims, 10 Drawing Figures

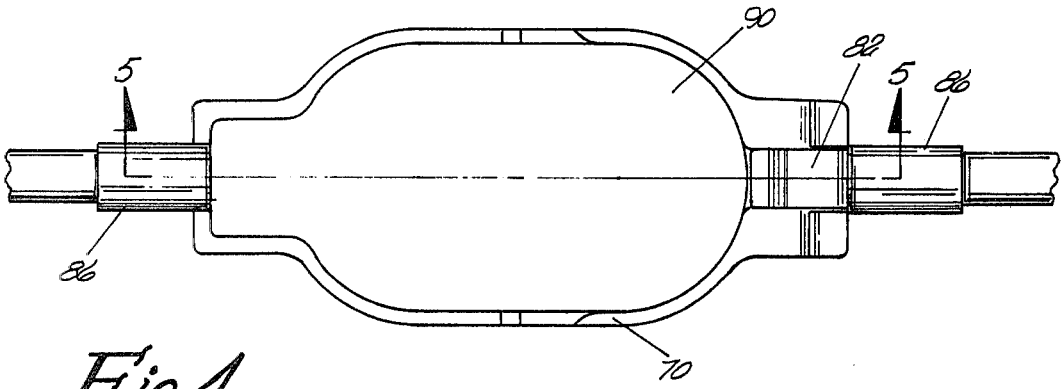
Fig 4
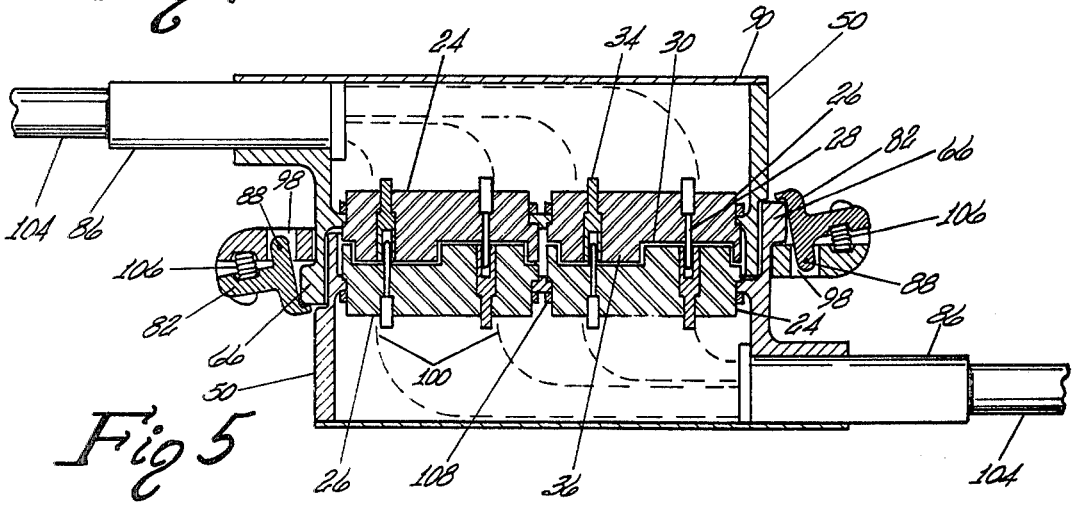
Fig 5
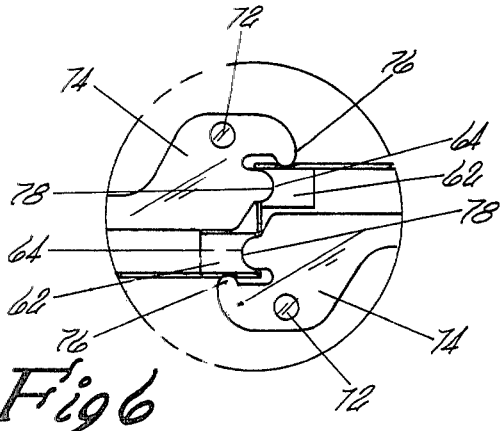
Fig 6
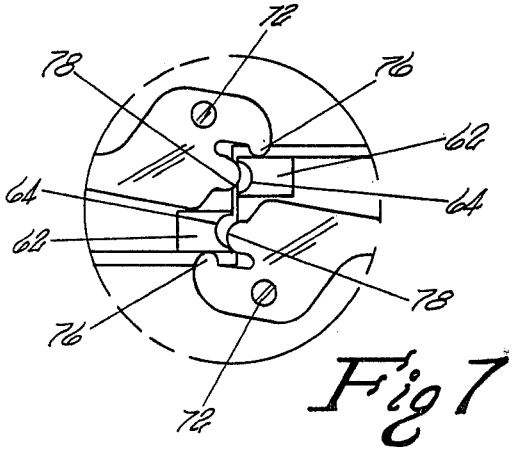
Fig 7
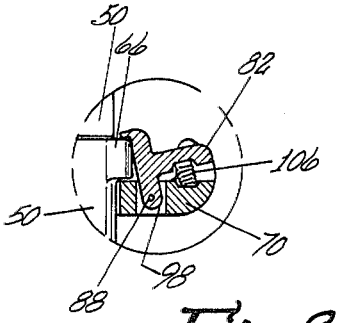
Fig 8a
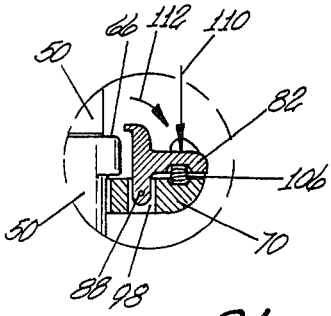
8b
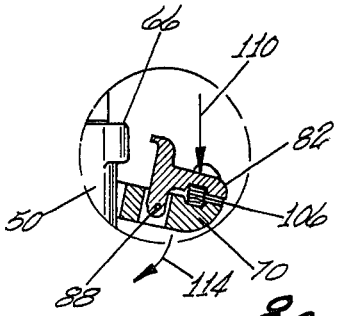
8c

MULTIPLE PIN CONNECTOR FOR MULTIPLE CONDUCTOR CABLE

BACKGROUND OF THE INVENTION

1. Field of the Invention

This invention relates to a multiple pin connector for use with a multiple conductor cable which is adapted for use in the geophysical industry. Specifically, this invention relates to a connector for multiple conductor cables which, when cooperating with an identical connector, forms a locked assembled connector device wherein the connectors are joined together by a keyway and key when in an assembled position and which is adapted to be positively separated and disassembled by rotation of a stirrup interlock.

2. Disclosure of the Prior Art

It is known in the art to provide a connecting device for multiple wire electrical cables. In certain electrical cable assemblies, a multi-conductor cable is adapted to have a male connector at one end and a female connector socket at the other end. In order to assemble a plurality of multiple conductor cables together, a female connector socket of one cable is mated with the male connector of another cable.

In the geophysical field, it is usually necessary to connect a plurality of cables together in order to enable the recording and collection of seismic data and to permit operation of seismic data acquisition and processing equipment and components.

Typically, in the geophysical field, a plurality of cables are arranged such that it would be difficult to insure that a male-to-female relationship exists between one end of a cable connector and a second end of a cable connector. To this extent, a number of multi-conductor cable connectors are known in the art. One such multi-conductor cable connector is disclosed in U.S. Pat. No. 3,745,511. The multi-conductor cable connector of U.S. Pat. No. 3,745,511 utilizes a male connector and female connector socket assembled in a side-by-side relationship to permit an identical connector to mate with a male connector and female connector socket in forming an assembled connector. Upon connection, a rotatable locking ring is provided for each engaging male connector and female connector socket that is rotated into a locking position to lock the two mini connectors and hold them from moving apart or into a second unlocking position which allows two connectors to be moved apart and separated.

In the multi-conductor cable connector described in U.S. Pat. No. 3,745,511, it is necessary that both locking rings be rotated into an unlocking position before the two identical connectors can be separated. If only a single locking ring is rotated into an unlocking position with the other locking ring remaining in locking position, any attempt to open or pull apart the multi-conductor cable connectors may result in bending of the pins or otherwise damage the connection therebetween. Further, in order to disassemble an assembled connector formed of two multi-conductor cable connectors, it is necessary to rotate both locking members into an unlocking position and to physically pull apart the two connectors.

Another cable connector is disclosed in Canadian Pat. No. 881,128 which comprises a connector having a hermaphrodite male and female insert which has a rectangular or square geometrical dimension. In the connector disclosed in Canadian Pat. No. 881,128, elongated male connector pins and elongated female connector sockets are orientated in parallel spaced relationship and in an identical pattern and orientated generally perpendicular to the long internal axis of the cable such that any longitudinal tension on the cable would be resisted by the sure strength of the pins and sockets.

Geo Space Corporation, located at Houston, Texas, through its Canadian subsidiary, Geo Space Canada Ltd., offered for sale and sold a cable connector generally known as a VCC multiple cable connector. The VCC cable connector generally utilized the male and female connector components described in Canadian Pat. No. 881,128, together with an unlocking cam member, which was adapted to enable the user to separate, by means of the cam, an assembled connecting device formed of two identical cable connectors into two separate components. The unlocking cam included a cam surface which, upon rotation of the unlocking cam, urged the two identical cable connectors in opposite directions, disengaging the male pins and female sockets to enable the user to easily disassemble the cable connector.

Geo Space Corporation of Houston, Tex., offered for sale and sold a multi-conductor cable connector having circular shaped inserts wherein each insert was comprised solely of all male pins or all female sockets which was adapted to cooperate with an identical connector to enable the male pins to engage in electrical connection with the female sockets upon connection of two identical connectors together to form an assembled locked unit. In addition, the connector further included an unlocking cam member which operated in substantially the same manner as the unlocking cams utilized in the VCC cable connector described above.

Cannon ITT offers for sale and sells a Geophysical Series Hermaphroditic Connector which utilizes a recognized 170-second electrical contact circular hermaphroditic land cable connector designed for the geophysical industries for use in hostile environments. The ITT connector comprises a circular shaped insert having two areas, each of which is semi-circular in shape wherein one area comprises male pins and a second area comprises female sockets. The insert is adapted to be connected to one end of the cable, and cooperates with another end of the cable having an identical connector to form a cable connecting means. The connection and disconnection of the single insert connector is accomplished manually or, in order to insure an important mechanical connection, a mounting housing can be used in order to bolt an insert from a cable and a mating member together to form, assemble and connect together a single insert which is joined together by bolts or other fastening means.

SUMMARY OF THE INVENTION

The multiple conductor cable connector for multiple conductor cables disclosed herein overcomes many of the disadvantages of the prior art cable connectors. The known multiple pin connectors used in the seismic industry are generally formed of two adjacent planar inserts, one of which is formed of male pins and the second which is formed of female sockets. Locking and unlocking of the multiple pin connector of the prior art are locked into an integral unit by use of rotatable locking rings as described above. In order to insure proper disconnection, it is necessary to concurrently rotate both locking rings into an open position and then to manually pull apart the two identical connectors.

In the other known prior art devices, two identical multiple pin cable connectors are held together solely by the contacting friction and separation force characteristics of the male pins and female sockets. Further, in order to obtain separation of two identical units, the two connectors must be manually pulled apart or are separated by use of an unlocking cam which, upon rotation, causes a physical initial separation between the two identical connectors, enabling the user to manually separate the two identical connectors into two separate units.

The present invention overcomes the disadvantages of the prior art devices by use of a novel and unique stirrup interconnector having a bifurcated locking arm which terminates in a differential locking member. The locking member includes a key and a cam which is adapted to lock a pair of identical connectors into an assembled unit when the stirrup interconnector is in a locked position and to positively forceably separate two identical conductors when the differential locking member is rotated into a release position.

An assembled connecting unit is formed by use of two identical multiple pin connectors and can be easily assembled by urging the two identical connectors into mating engagement relationship to form a sealing engagement therebetween. The stirrup interconnector includes a releasable clamping member which engages and locks with a clamping lip located on the opposite cable connector. Thus, locking of two assembled units is obtained by a short vertical rotation of a stirrup interconnector.

Separation of an assembled connector unit is accomplished by disengaging the release clamp from the clamping lip and rotating the stirrup interconnector vertically into a release position. This results in the key of the stirrup interconnector disengaging from a keyway and a cooperating cable connector while concurrently positively urging the two units into separation by means of a cam which cooperates with a differential locking boss on an opposed identical connector.

One advantage of the present invention is that any end of a multi-conductor cable can be joined with an adjacent end of a multi-conductor cable having an identical unit thereon.

Yet another advantage of the present invention is that, when the two units are assembled into mating engagement, the two identical connectors are positively locked into position by two releasable connecting members which are moved or displaced in a slight vertical direction rotating a stirrup interconnector to cause a locking arrangement between a keyway and a key to insure positive locking between the two identical connectors.

Yet a further advantage of the present invention is that a longitudinal tension on the cables will not disrupt, bend, or otherwise cause the mating male pins and female sockets to disengage. Any longitudinal tension or strain is offset by the positive clamping action of the releasable clamp in engagement with a clamping lip.

Yet a further advantage of the present invention is that two identical units formed into an assembled locked unit can be easily and quickly disengaged by easily concurrently releasing a releasable clamp in disengagement from the clamping lip and slightly rotating each stirrup interconnector of each unit a small vertical distance which concurrently unlocks the two connectors while concurrently positively urging the two units apart from each other by a camming action which is concurrently applied to each identical cable connector.

These and other objections and advantages of the present invention will be more completely described in detail in the following specification describing the preferred embodiment, the accompanying drawings and claims therein.

BRIEF DESCRIPTION OF THE DRAWINGS

FIG. 4 is a top view of an assembled unit formed of two cable connector units;

FIG. 5 is a cross-sectional view of an assembled connector unit taken along section lines 55 of FIG. 4;

FIG. 6 is a distorted view showing differential locking members located at the bifurcated arms of a stirrup interlock in a locked position wherein the differential locking members of each identical connector have its key cooperating with a keyway in a differential locking boss located on an opposed identical connector;

FIG. 7 is an exploded view of the differential locking members of an assembled integrated unit in an unlocking position wherein the differential locking members have a cam which positively separates two identical connectors when the stirrup interlock is moved to an unlocking position; and FIGS. 8*a*, 8*b* and 8*c* are a series of exploded views of the releasable clamping member in a locking position, being rotated into an unlocking position and rotation of the stirrup interlock into an unlocking position respectively.

DESCRIPTION OF THE PREFERRED EMBODIMENT

Figure 1:
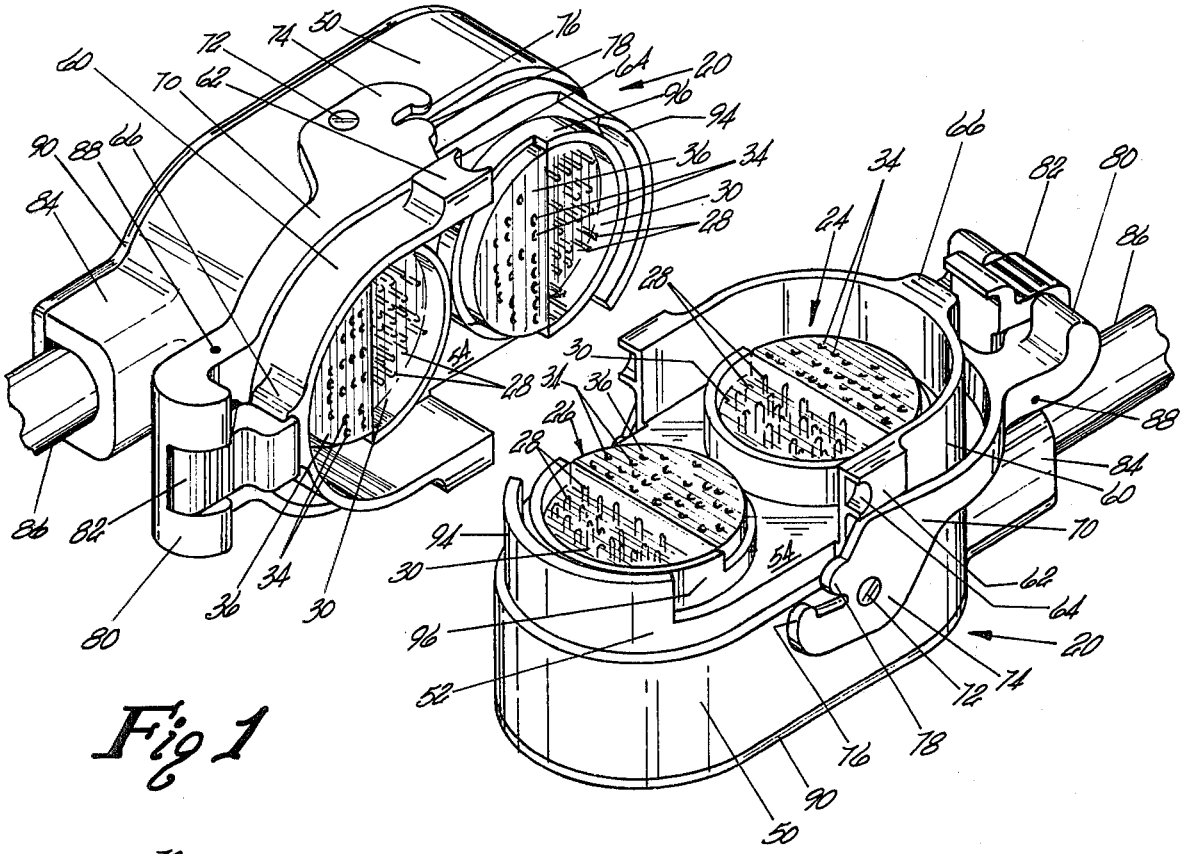
FIG. 1 is a perspective view of two identical connectors positioned relative to each other to enable connection therebetween.

The pair of connectors for a multiple conductor cable are generally illustrated as 20 in FIG. 1. Typically, the connectors are positioned such that one end of a multi-conductor cable can be connected to another end of an adjacent multi-conductor cable without a requirement for orientation of the conductors into any predetermined position. Each of the connectors for a multi-connector cable 20 includes a first insert 24 and a second insert 26. Both the first insert 24 and the second insert 26 include a first selected portion or section 30 and a second selected section 36. The first selected section of inserts 24 and 26 include a plurality of male connector pins 28 which are located in the first selected section 30. In a similar arrangement, in a second selected portion 36 of inserts 24 and 26 are located a plurality of female connector sockets 34. The first selected portion 30 and the adjacent second selected portion 36 of inserts 24 and 26 may be formed of any geometrical shape. The preferred embodiment is a semi-circular shape as illustrated in FIG. 1. The male pins 28 and the female connector sockets 34 are arranged in each of the first and second inserts 24 and 26 in a parallel spaced relationship and in an identical pattern to form a hermaphrodite connector.

The two connectors illustrated generally as 20 include a base 50 which has a face plate 52. The face plate 52 defines an interconnecting surface 54 for supporting the first and second inserts 24 and 26 in an adjacent planar predetermined spaced relationship. The first and second selected portions 30 and 36 of inserts 24 and 26 are positioned within the face plate 52 in an identical geometrical spacial orientation relative to each other with the male pins 28 and the female connector sockets 34 extending generally perpendicular to the interconnecting surface 54 of the face plate 52.

The face plate 52 includes means for defining a raised partial collar 60, which can be characterized as a "U-shaped" collar, which extends around one of the first and second inserts 24 and 26. In the embodiment illustrated in FIG. 1, the partial collar or "U-shaped" collar 60 is located around the first insert 24. However, the partial collar 60 could be located above the second insert 26. Of course, a mating cable connector would have to be identical in form and having the raised partial collar 60 located along the same corresponding insert. In addition, face plate 52 includes means for defining a raised annular guide collar 94 located in a spaced position around the periphery of locking rings 96.

The raised partial collar 60 extends around the first insert 24 and terminates with the collar ends intermediate the spaced distance between the first and second inserts 24 and 26. The collar ends of raised partial collar 60 include means for defining a differential locking boss 62 at the ends thereof. The differential locking boss 62 includes a keyway 64 extending toward the other of the first and second inserts 24 and 26. The raised partial collar 60 includes a clamping lip 66 located on the exterior of the raised partial collar 60, and it is positioned adjacent the edge of the first insert 24. In addition, the clamping lip 66 is located in substantial alignment with the first and second inserts 24 and 26.

A stirrup interconnector 70 has, at one end thereof, bifurcated locking arms each terminating in a differential locking member 74 which is pivotally mounted to the base 50 at a pivot point 72. The differential locking member is formed of a cam 76 and a key 78. The other end of the extended stirrup interconnector 70 terminates in a releasable clamping member 80. The releasable clamping member 80 includes a clamping member 82 which is adapted to cooperate with the clamping lip 66.

The stirrup interconnector 70 is positioned to receive base 50 between the bifurcated locking arms with the raised partial collar 60 and clamping lip 66 located adjacent the releasable clamping member 80. Each differential locking member 74 is pivotally mounted to the base 50 at a pivot point 72 and is adapted to rotate at pivot point 72 around the base 50. The stirrup interconnector 70, when rotated around pivotal mounting 72, positions the releasable clamp 82 in clamping engagement with the clamping lip 66. When this occurs, the stirrup interconnector 70 is in locking position. Conversely, when the releasable clamp 82 is rotated about its pivot point 88, the clamping member 82 is moved into disengagement from the clamping lip 66. Thereupon, when the stirrup interconnector 70 is rotated into a release position, each of the differential locking members 70 is likewise rotated. When the releasable clamp 82 is in clamping engagement with the clamping lip 66, the differential locking boss 62 on one connector is adapted to cooperate with a differential locking member key 64 of an identical connector to form a locked assembled connector unit of two identical connectors when the stirrup interconnector 70 is rotated into locking position.

When the clamping member 82 is moved into a disengagement position from the clamping lip 66, the stirrup interconnector 70 is rotated into unlocking position, and the cam 76 of each stirrup interconnector 70 positively engages an opposed adjacent surface of a differential locking boss 62 on an identical connector to urge each connector apart in opposite directions, thereby releasing the connectors forming an assembled locked connector unit.

Figure 2:
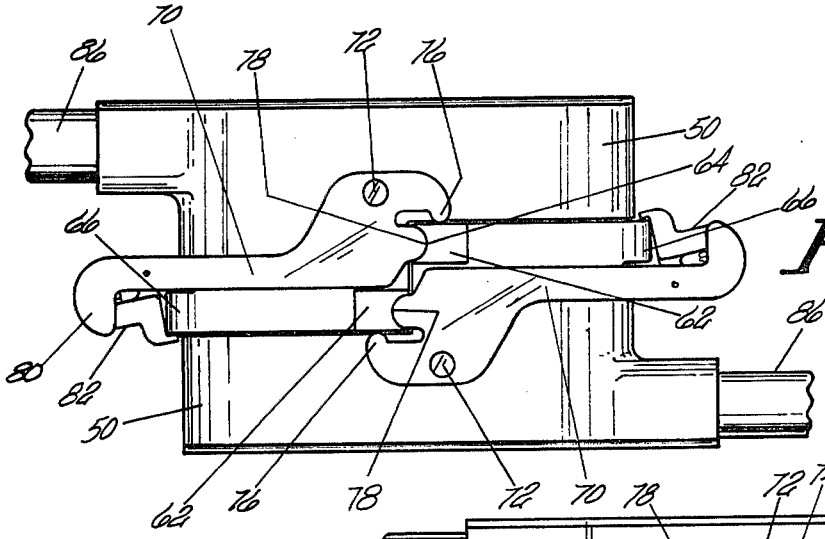
FIG. 2 is a front elevational view of an assembled connector unit comprising two identical cable connectors of the present invention wherein the stirrup interconnector is in a locking position forming a locked assembled connecting unit.

FIG. 2 shows a locked assembled unit formed of two identical connectors 50. In FIG. 2, the stirrup interconnectors 70 are shown with each of the respective keys 78 in locking engagement with a keyway 64 in a cooperating differential locking boss 62. In addition, the clamping member 82 is being urged into clamping engagement with the clamping lip 66 of a cooperating connector.

Figure 3:
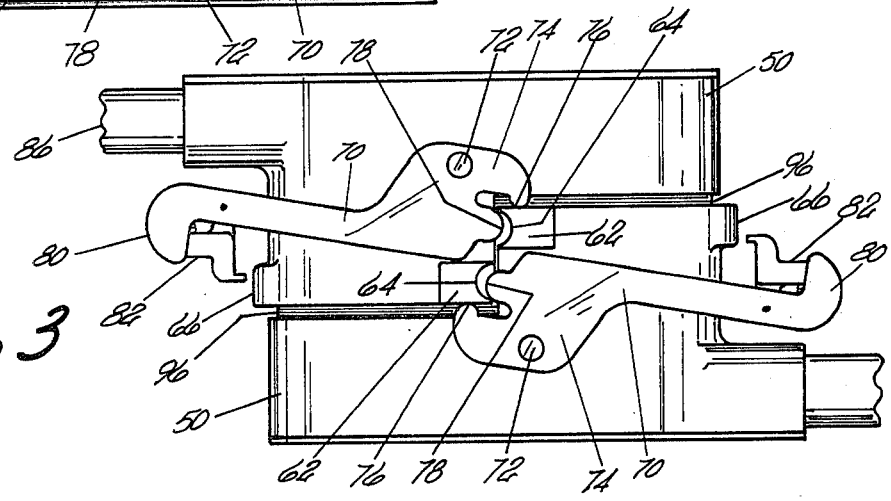
FIG. 3 is a front elevational view of two identical connectors illustrated in FIG. 2 wherein the stirrup interconnectors have been rotated into unlocking position to positively separate the two identical connectors.

FIG. 3 illustrates two identical connectors which form an assembled connector unit being disengaged and unconnected. In order to disconnect an assembled unit of two connectors 50, the clamping member 82 is rotated and disengaged from the clamping lip 66, and the stirrup interconnector 70 is rotated about its pivot point 72. As each stirrup interconnector 70 is rotated about pivot point 72, the key 78 in each differential locking member 74 moves away from the keyway in a corresponding differential locking boss 16. As the stirrup interconnector 70 is rotated about pivot point 72, the cam 76 on each of the differential locking members 74 contacts an adjacent corresponding surface of the differential locking boss 62 which is positioned adjacent the cam 76. As the stirrup interconnector 70 is rotated into its unlocked position, the cam 76 positively urges the connector apart from the opposed connector 50 by a separation force which is developed between both cams 76 and differential locking bosses 62.

FIG. 4 shows in greater detail the assembled locked unit comprising two identical cable connectors. The base 50 is shown to include a baseplate 90 which is adapted to sealingly cover the hollowed-out central area within the base 50 to permit access to the multi-conductors of the cable and terminations of the male pins and female sockets.

FIG. 5 shows the assembled unit in greater detail wherein the multi-conductor cable 104 cooperates with a cable shield 86 in passing through the passageway formed in the base into the hollowed-out central area of the base 50. The cable shield 86 cooperates with the passageway in base 50 to hold the multi-conductor cable in a position which is substantially perpendicular to the axis of each of the first and second inserts 24 and 26, thereby providing a means for resisting disconnection of a pair of the cable connectors from the longitudinal tension on the connected cables.

The first and second inserts 24 and 26 are adapted to have the terminations thereof connected to conductors from each of the cables as shown by the dashed lines identified as 100. FIG. 5 further depicts the relationship between the clamping member 82 which is pivotally mounted at 88 within an aperture 98 of the stirrup interconnector 70. The pivotally mounted releasable clamping member 82 is adapted to slide over and engage the clamping lip 66 on the partially raised collar 60 as shown in FIG. 1. The stirrup interconnector 70 is shown in locking position in FIG. 5 and is held in locking position by a resilient means such as, for example, a coil spring 106. The resilient means or coil spring 106 is adapted to urge the latching member into clamping engagment with the clamping lip 66 when the stirrup interconnector 70 is rotated into locking position as shown in FIG. 5. When the latching member 82 is subject to a force which overrides the resilient means or coil spring 106, the releasable clamping member 82 is pivoted about pivot point 88 enabling the releasable clamping member to disengage from the clamping lip 66. With the releasable clamping member 82 disengaged from the clamping lip 66, the stirrup interconnector 70 is rotated into an unlocking position positively separating the two cable connectors as described in connection with FIG. 3.

FIG. 6 shows in greater detail the relationship between the differential locking members 74 of one connector cooperating with the differential locking boss of a cooperating identical connector. Specifically, FIG. 6 shows the position when the differential locking members 74 are in locking position, positioning keys 78 into the keyways of a cooperating differential locking boss 62. The cams 76 are positioned to cooperate with an opposed adjacent surface of a differential locking boss 62 on an identical connector.

FIG. 7 shows the relationship between the differential locking members 74, keys 78, cams 76 and differential locking bosses 62 when the stirrup interconnector 70 is positioned into the unlocking position as shown in FIG. 3.

When the stirrup interconnector 70 is in locking position, generally depicted in FIG. 2, the releasable clamping member 82, as shown in FIG. 8*a*, is in clamping engagement with the clamping lip 66. The resilient means or coils spring 106 has a force directed against the clamping member 82 which causes a rotational force about pivot point 88 which holds the clamping member into clamping engagement with clamping lip 66. This insures a positive locking arrangment between two interconnected cable connectors at all times.

FIG. 8*b* shows the initial step to be undertaken in order to disengage or disassemble two assembled interlocked units. A force depicted by arrow 110, such as use of a finger of a user, produces a force which overrides the force developed by the resilient means of coil spring 106 to permit rotation of the latching member about its pivot point 88 removing the latching member 82 from clamping engagement with the clamping lip 66. With the latching member in the unclamped or disengaged position, the stirrup interconnector 70 is then rotated into the unlocking position which is illustrated in FIG. 3. FIG. 8*c* shows the relationship between the clamping member having the force 110 applied thereto to permit the latching member 82 to be held in the unclamped position as the stirrup interconnector 70 is rotated in a counterclockwise position, as shown by arrow 114, into its unlocked position as illustrated in FIG. 3. When the override force 110 is removed from the latch member 82 with the stirrup interconnector 70 in the unlocked position, the resilient means of spring 106 will again rotate the latching member about its pivot point 88 into its normal position except that the latching member is not adjacent or in engagement with the clamping lip 66 due to the physical position of the differential locking members 74 being displaced from the clamping lip 66.

In the preferred embodiment; the first and second inserts 24 and 26 are depicted to comprise 50% male pins and 50% female connector sockets. However, it is anticipated that the first and second inserts 24 and 26 could be completly male pins or completly female connector sockets or to comprise any other combination of male pins or female connector sockets which are necessary in order to practice the invention. However, it is necessary that identical connectors have the same pin arrangement and the same spacial and geometrical relationship to each other to enable the interconnection of two identical connectors to form an assembled connecting unit. Of importance is the positive locking feature which occurs due to the use of a differential locking member 74 together with a spring-loaded clamping member 82 to insure that, when the differential locking member 74 is in a locked position, a positive locked condition exists so that shaking, dropping or other physical forces applied to the cable connector will not cause the separation therebetween. Further, locking rings 96 may be positioned on the periphery of each of the first and second inserts 24 and 26. The locking rings 96 have a raised lip to enclose the male pins and are positioned to engage and cooperate with locking rings on a separate identical connector such, that the units are in a sealing engagement when assembled. Further, the first and second inserts 24 and 26 are held within the face plate by means of screw lock member 108, as shown in FIG. 5.

The cable connectors of the present invention have particular utility for use in adverse environmental conditions, such as in marshes, swamps, or other field conditions normally encountered by seismic crews in field use of seismic data acquisition equipment including geophones, seismic data acquisition equipment, recording equipment, and the like.

In light of the harsh environments to which the cable connector is subjected, the connector is preferably constructed of aluminum, steel, or other metal.

What is claimed is:

1. A multiple pin connector for a multiple conductor cable comprising a housing having a face plate, a hollowed-out central area and means defining a passageway to enable a multiple conductor cable to extend from the hollowed-out central area to the exterior of the housing, said housing including means for defining a raised "U-shaped" collar around the periphery of one end of the face plate and with each collar end of the "U-shaped" collar terminating at the center of the face plate, each of said "U-shaped" collar ends terminating in a differential locking boss having a keyway extending toward the other end of the face plate and a clamping lip located on the exterior at the center of the "U-shaped" collar;

a pair of inserts positioned in said face plate and extending from the exterior of the face plate into the hollowed-out central area, each of said inserts including at least one of a plurality of elongated male connectors and a plurality of elongated female connector sockets, said elongated male connectors and elongated female connector sockets extending substantially perpendicular from the face plate surface into the hollowed-out central area, said pins and sockets being arranged in each of said first and second inserts in a parallel spaced relationship and in an identical pattern to form a hermaphrodite connector; and a stirrup interconnector having at one end thereof bifurcated locking arms, each terminating in a differential locking member formed of a key and a cam, and the other end of the stirrup interconnector terminating in a releasable clamping member, said stirrup interconnector being positioned to receive the housing between the bifurcated locking arms with the "U-shaped" collar and clamping lip located adjacent the releasable clamping member, each differential locking member being pivotally mounted to the housing to afford rotation of the stirrup interconnector therearound, said stirrup interconnector being adapted to rotate around the pivotal mountings to position the releasable clamp in clamping engagement with the clamping lip when the stirrup interconnector is rotated into a locking position and to position the releasable clamp in disengagement from the clamping lip when the stirrup interconnector is rotated into a release position, each of said differential locking members being adapted to cooperate with a differential locking boss on an identical connector with the keys on one connector received in the keyways of the other connector to hold them in locked assembly and the cams located to aid in connector separation.

2. The connector of claim 1 comprising cable entrance means positioned between the passageway and a multiple conductor cable for receiving and supporting a multiple conductor cable in a position perpendicular to the axis of each insert, thereby resisting disconnection from longitudinal tension on connected cables.

3. The connector of claim 1 wherein the first and second inserts include a first selected portion and a second selected portion and wherein each have an equal number of male pins and female sockets, and wherein each selected portion is in the form of a semi-circle.

4. The connector of claim 1 wherein said differential locking member has the key axis formed in a plane substantially parallel to the surface of the face plate and the cam axis is positioned substantially perpendicular to the key axis.

5. The connector of claim 3 wherein said releasable clamp comprises a pivotally mounted latching member adapted to slide over and engage the clamping lip when the stirrup interconnector is rotated into locking position; and resilient spring means adapted to urge the latch member into clamping engagement with the clamping lip when the stirrup interconnector is rotated into locking position, said latching member being adapted to be manually rotated around its pivot point to override the force of the resilient spring means to enable the latching member to be disengaged from and moved away from the clamping lip when the stirrup interconnector is rotated to a release position.

6. A connector for a multiple conductor cable comprising a first and second insert each having a plurality of elongated male connector pins located in a first selected portion of the insert and a plurality of elongated female connector sockets located in an adjacent second selected portion of the insert, said pins and sockets being arranged in each of said first and second inserts in a parallel spaced relationship and in an identical pattern to form a hermaphrodite connector;

a base having a face plate defining an interconnecting surface for supporting said first and second inserts in an adjacent planar predetermined spaced relationship, with the first and second selected portions of each insert being positioned within the face plate in an identical geometrical spacial orientation relative to each other with the pins and sockets thereof extending generally perpendicular to the interconnecting surface of the face plate, said face plate including means defining a raised partial collar extending around one of the first and second inserts which terminates with its collar ends intermediate the spaced distance therebetween;

means defining, on the collar ends, a differential locking boss having a keyway extending toward the other of the first and second inserts and a clamping lip located on the exterior of the raised collar adjacent the edge of said one of the first and second inserts and in substantial alignment with the first and second inserts;

a stirrup interconnector having at one end thereof bifurcated locking arms, each terminating in a differential locking member formed of a key and a cam, and the other end of the stirrup interconnector terminating in a releasable clamping member, said stirrup interconnector being positioned to receive the base between the bifurcated locking arms with the raised collar and clamping lip located adjacent the releasable clamping member, and with each differential locking member pivotally mounted to the base to afford rotation of the stirrup interconnector therearound, said stirrup interconnector being adapted to rotate around the pivotal mountings to position the releasable clamp in clamping engagement with the clamping lip when the stirrup interconnector is rotated into a locking position, and to position the releasable clamp in disengagement from the clamping lip when the stirrup interconnector is rotated into a release position, each of said differential locking members being positioned to cooperate with a differential locking boss on an identical connector wherein the key is adapted to be inserted into locking engagment with a keyway of a differential locking boss on an identical connector to form a locked assembled connector of two identical connectors when the stirrup interconnector is rotated into a locking position and wherein the cam is adapted to cooperate with an opposed adjacent surface of a differential locking boss on an identical connector to urge the connector apart from an identical connector in opposite direction when the stirrup interconnector is rotated into release position forming an unlocked connector; and means positioned in the base for receiving and supporting a multiple conductor cable in a position perpendicular to the axis of each insert thereby resisting disconnection of a pair of such connectors from longitudinal tension on connected cables.

7. The connector of claim 6 wherein the first and second inserts have an equal number of male pins and female sockets and wherein each selected portion is in the form of a semi-circle.

8. The connector of claim 6 wherein said differential locking member has the key axis formed in a plane substantially parallel to the interconnecting surface of the face plate and the cam axis is positioned substantially perpendicular to the key axis.

9. The connector of claim 8 wherein said releasable clamp comprises a pivotally mounted latching member adapted to slide over and engage the clamping lip when the stirrup interconnector is rotated into locking position; and resilient means adapted to urge the latching member into clamping engagement with the clamping lip when the stirrup interconnector is rotated into locking position, said latching member being adapted to be manually rotated around its pivot point to override the force of the resilient means to enable the latching member to disengage and move from the clamping lip when the stirrup interconnector is rotated to a release position and to enable the latching member to engage the clamping lip when the stirrup interconnector is rotated into locking position.

10. The connector of claim 6 wherein the base including the face plate is formed of metal.

11. The connector of claim 7 wherein the base further comprises means defining a hollowed-out central area to enable selective connecting of the multiple cable conductors to the male pins and female sockets; and a base plate adapted to sealingly cover the hollowed-out central area to permit access to the cable and pin connections.

12. The connecting device of claim 9 wherein the resilient means is a coil spring.

13. The connector of claim 6 wherein the face plate further includes means for defining a raised lip which is positioned adjacent the other of said first and second inserts and located in substantial alignment with the two inserts and the clamping lip on the raised collar member.

14. The connector of claim 13 wherein the face plate includes a locking ring positioned around the periphery of each of said first and second inserts, each of said locking rings having a raised lip to enclose the male pins and positioned to engage and cooperate with locking rings on a separate identical connector when two identical connectors are locked together forming an assembled unit.

* * * * *